US011781226B2

(12) United States Patent
Whitmore et al.

(10) Patent No.: US 11,781,226 B2
(45) Date of Patent: Oct. 10, 2023

(54) CATHODIC CORROSION PROTECTION WITH CURRENT LIMITER

(71) Applicant: Vector Remediation Ltd., Winnipeg (CA)

(72) Inventors: David William Whitmore, Winnipeg (CA); Geoffrey Richard Child, Winnipeg (CA)

(73) Assignee: Vector Remediation Ltd., Winnipeg (CA)

( * ) Notice: Subject to any disclaimer, the term of this patent is extended or adjusted under 35 U.S.C. 154(b) by 521 days.

(21) Appl. No.: 16/859,029

(22) Filed: Apr. 27, 2020

(65) Prior Publication Data

US 2020/0308712 A1 Oct. 1, 2020

Related U.S. Application Data

(63) Continuation-in-part of application No. 15/644,064, filed on Jul. 7, 2017, now Pat. No. 10,633,746.

(51) Int. Cl.

| | |
|---|---|
| ***C23F 13/16*** | (2006.01) |
| ***C23F 13/04*** | (2006.01) |
| ***C23F 13/20*** | (2006.01) |

(52) U.S. Cl.

CPC ..... *C23F 13/16* (2013.01); *C23F 13/04* (2013.01); *C23F 13/20* (2013.01); *C23F 2201/02* (2013.01); *C23F 2213/22* (2013.01)

(58) Field of Classification Search

CPC .. C23F 13/02–13/22; C23F 2201/00–2201/02; C23F 2213/00–2213/32; C23F 2213/10–2213/11

See application file for complete search history.

(56) References Cited

U.S. PATENT DOCUMENTS

| | | | | |
|---|---|---|---|---|
| 3,515,654 A * | 6/1970 | Bordalen | ..... | C23F 13/04 204/230.2 |
| 3,636,409 A * | 1/1972 | Stephens, Jr. | ..... | C23F 13/04 114/221 R |
| 4,381,981 A * | 5/1983 | Maes | ..... | C23F 13/04 204/196.04 |

(Continued)

OTHER PUBLICATIONS

Davies et al ("Cathodic protection mechanism and a review of criteria", 2010, pp. 41-55). (Year: 2010).*

*Primary Examiner* — Alexander W Keeling

(74) *Attorney, Agent, or Firm* — Adrian D. Battison; Ade & Company Inc.; Ryan W. Dupuis

(57) ABSTRACT

In a method for cathodically protecting and/or passivating a metal section in an ionically conductive material such as steel reinforcement in concrete or mortar, an impressed current or sacrificial anode communicates ionic current to the metal section and a storage component of electrical energy which can be a cell, battery or capacitor is provided as a component of the anode. A current limiter is provided which prevents excess current draining the supply. This can be a semi-conductive device such as a transistor or diode is connected in the path from the anode to the metal section to limit the cathodic protection current to a value of the order of 1 milliamp. When a diode or similar device is used the current can be limited to the reverse leakage current of the diode.

11 Claims, 6 Drawing Sheets

(56) References Cited

U.S. PATENT DOCUMENTS

| | | | | |
|---|---|---|---|---|
| 5,667,649 | A * | 9/1997 | Bushman | C23F 13/12 205/741 |
| 8,211,289 | B2 * | 7/2012 | Glass | C23F 13/06 205/730 |
| RE45,234 | E * | 11/2014 | Whitmore | C23F 13/22 205/734 |
| 2015/0299868 | A1 * | 10/2015 | Sergi | C23F 13/10 205/730 |

* cited by examiner

CATHODIC CORROSION PROTECTION WITH CURRENT LIMITER

This application is a continuation in part application of application Ser. No. 15/644,064 filed Jul. 7, 2017 and now issued on Apr. 28, 2020 as patent Ser. No. 10/633,746, the disclosure of which is incorporated herein by reference.

This invention relates to a method and for cathodically protecting and/or passivating a metal section in an ionically conductive material particularly to an arrangement which limits a current supply by the anode assembly.

BACKGROUND OF THE INVENTION

Impressed current systems using a battery are known. Such impressed current systems can use other types of power supply including common rectifiers which rectify an AC voltage from a suitable source into a required DC voltage for the impressed current between the anode and the steel. It is also known to provide solar panels to be used in a system of this type.

In all cases such impressed current systems require regular maintenance and checking of the status of the power supply to ensure that the power supply does not fail leading to unexpected and unacceptable corrosion or overprotection of the steel within the structure to be protected. While such maintenance can be carried, this is a relatively expensive process.

Alternatively, galvanic systems can be used which avoid the necessity for any power supply since the voltage between the steel and the anode is provided by selecting a suitable material for the anode which is sufficiently electronegative to ensure that a current is generated to provide corrosion protection.

There are two primary limitations of ordinary galvanic anodes as used in steel reinforced concrete. The first relates to the mass of zinc per anode which, depending on the required current output, limits the useful life of the anode. The second is the actual current output of the anode which may or may not be sufficient to halt corrosion of the steel. The current output is limited by the driving voltage, which is essentially a fixed property and varies with the circuit resistance which is a function of the exposure conditions, age of the anode, and build-up of corrosion products over time.

Reference is also made to U.S. Pat. No. 8,961,746 (Sergi) issued Feb. 24, 2015, U.S. Pat. No. 8,968,549 Mar. 3, 2015 (Sergi) and U.S. Pat. No. 7,264,708 (Whitmore) issued Sep. 4, 2007 the disclosures of which are incorporated herein by reference or may be referenced for more relevant information.

SUMMARY OF THE INVENTION

According to a first aspect of the invention there is provided a method for cathodically protecting and/or passivating a steel member in an ionically conductive concrete or mortar material, comprising:

providing an anode construction for communication of an electrical current to the steel member in the ionically conductive concrete or mortar material;

generating a voltage difference between the anode construction and the steel member so as to cause a current to flow through the ionically conductive concrete or mortar material between the anode and the steel member so as to provide cathodic protection of the steel member;

providing at least one electrically conductive circuit between the anode construction and the steel member;

providing a transistor in the electrically conductive circuit which acts to limit the current between the steel member and the anode construction to a maximum value;

wherein the current through the transistor is limited by a control current or voltage applied to a control terminal of the transistor.

In one arrangement, a resistance in the circuit is used to generate said control current or voltage from the voltage difference between the anode and the steel member.

In one arrangement, the anode construction and the transistor form components of a common body which is at least partly buried in or attached to, as a single unit, the concrete or mortar material.

In one arrangement, a voltage difference between the anode construction and the steel member is used to generate a reference voltage or current for the transistor.

In one arrangement, the common body is buried in the concrete or mortar material while in an unset condition and the concrete or mortar material is caused to set with the common body therein and wherein said current limiting components which limit the current to said maximum value act to restrict formation of gas bubbles in the concrete or mortar material at the steel member and/or at the anode while the concrete or mortar material sets.

In one arrangement, the anode construction comprises a sacrificial anode.

In one arrangement, said anode construction comprises a sacrificial anode and an impressed current anode, generating a voltage difference between the sacrificial anode and the steel member so as to cause a first current to flow through the ionically conductive concrete or mortar material between the first sacrificial anode and the steel member so as to provide cathodic protection of the steel member wherein a voltage difference between the impressed current anode and the steel member is generated by a storage component of electrical energy with two poles for communicating a second current generated by release of the electrical energy and by electrically connecting one pole to the steel member and by electrically connecting the other pole to the second anode.

In this arrangement, the storage component can be contained within a sleeve or canister defining the anode on an exterior surface. In this arrangement, the impressed current anode can comprise stainless steel.

Preferably the transistor is a normally closed transistor so that, if the control voltage or current falls below a threshold, the transistor allows continued passage of current between the anode and the steel member.

Preferably the transistor is an FET with a source and drain with the current through the FET controlled by a voltage at a gate.

In this arrangement, the voltage at the gate can be generated by a resistance in the electrical circuit.

In this arrangement, the voltage at the gate can be generated by a resistance across the transistor.

In this arrangement, the voltage at the gate can be generated across a cell connected between the anode and the transistor.

In this arrangement, the voltage at the gate can be generated by a sacrificial anode separate from said anode construction.

A second aspect of the present invention relates to a method for cathodically protecting and/or passivating a metal section in an ionically conductive material, comprising:

providing an anode for communication of an electrical current to the metal section in the ionically conductive material;

generating a voltage difference between the anode and the metal section so as to cause a current to flow through the ionically conductive material between the anode and the metal section so as to provide cathodic protection of the metal section;

and providing electrical components which limit the current to a maximum value.

In the present invention the arrangement for limiting the current is provided by connecting a semi-conductor device in an electrically conductive path between the anode and the metal, the semi-conductive device being arranged to restrict current to a leakage current and thus limit the current to a maximum value defined by the leakage current.

It is known that, when a semiconductor device including a P-N junction is reverse biased it should not conduct any current. However, due to an increased barrier potential, the free electrons on the P side are dragged to the positive terminal, while holes on the N side are dragged to the negative terminal. This produces a current of minority charge carriers and hence its magnitude is small. Within a typical temperature range, the reverse current is almost constant.

Reverse leakage current in a semiconductor device is the current from that semiconductor device when the device is reverse biased. The term is particularly applicable to most semiconductor junctions, especially diodes and thyristors. In general, such leakage currents can be used in devices such as diodes of the types, Silicon diodes, Shottky diodes, Zener diodes and Constant Current diodes. The same arrangement can be used in transistors such as those of the types: FET; IFET; MOSFET. The same arrangement can also be used in other devices such as an Analog Switch, Capacitor or Other PN devices.

In electronics, leakage is the gradual transfer of electrical energy/electrons across a boundary normally viewed as insulating such as:

Spontaneous discharge of a charged capacitor;

Flow of current across a transistor in the "off" state;

Reverse-polarized diode.

Reverse leakage current is also known as "zero gate voltage-drain current" with MOSFETs. The leakage current increases with temperature. As an example, the Fairchild Semiconductor FDV303N has a reverse leakage of up to 1 microamp at room temperature rising to 10 microamps with a junction temperature of 50 degrees Celsius. For all basic purposes, leakage currents are very small, and, thus, are normally negligible.

However up to now persons in the field of cathodic protection have not realized that the reverse or leakage current, of a diode or P-N junction device or similar devices such as those above which perform the similar function, provides the required level of current for use in cathodic protection at the required voltages and over the required time period.

The arrangement herein is preferably provided as a common component with the anode so that both can be attached to, buried in or engaged with the ionically conductive material. However, the components may be separate with the anode in contact with the material and the semi-conductor device located at a different position for example outside the material for servicing or other actions.

In a typical system described herein, the voltage difference in the reverse direction across the semi-conductive device is typically in the range 0.2 to 6 volts. This range is acceptable for cathodic protection systems using either a galvanic voltage using a sacrificial anode or using a low voltage power supply and an impressed current anode. The present inventor has realized that this level of voltage is suitable and matches the range of action of the semi-conductor device available.

Preferably the current for a single anode is in the range 0.1 to 5 milliamps and can be of the order of 100 μA or less. Typically using a conventional system without the current limiting arrangement, the current, especially initially may be over 10 times higher. The present inventor has realized that the current may be too high at the outset and can be reduced by the use of the system herein so that a longer life of the cathodic protection system can be obtained before the current falls below an acceptable level. The leakage current from electronic devices, including semi-conductors which are available have been found by the inventor herein to be suitable for the requirements.

In this way, a long life system can be designed with high charge capacity using this simple inexpensive arrangement of utilizing the leakage current through a diode or other similar device to limit the current at the outset and in some cases from the outset over many years during periods when the current would otherwise be higher. This allows the anode to remain active and providing the desired current for a longer time period.

The system also allows a sacrificial anode to provide a specifiable current for many years. This capability has not been possible with sacrificial anodes previously since the current from sacrificial anodes installed in outdoor environments exposed to the weather will increase and decrease significantly due to changes in temperature, humidity and the resistance of the ionically conductive material such as concrete. Preferably in one arrangement, the semi-conductor device forms part of a combined unit inserted in or in ionic contact with the ionically conductive material which includes the anode and a connector. In this arrangement, preferably the semi-conductor device is associated with and operates only in respect of a single anode.

The current limiting system can be used when the anode is installed and connected to the metal section while the ionically conductive material is unset where the limitation of the current by the semi-conductor device prevents gas generation during curing of the ionically conductive material.

In an impressed current system preferably the voltage difference is generated by a storage component of electrical energy with two poles for communicating electrical current generated by release of the electrical energy and by electrically connecting one pole to the metal section and by electrically connecting the other pole to the anode.

Preferably the diode is of the type having two connecting wires where one wire is connected directly or indirectly to the anode and the other wire is connected directly or indirectly to a mounting component for attachment to the metal section or to the metal section itself. The metal section is commonly reinforcing steel. Typically, the diode and the diode connecting wire cannot tolerate the high forces necessary to mount the anode to the metal section so that a fixed component is attached with the anode to provide the mounting forces. In one arrangement this may be a simple wire wrapping system well known in the art.

In another arrangement herein there is provided a mechanical clamp for the anode body onto the reinforcing bar. This arrangement can provide the following advantages:

The contacts act to bite into reinforcing steel;

The contacts make good connection even if surface of the bar is not clean such as contaminated with rust or concrete residue.

The clamp is adjustable to different bar sizes/diameters and sizes/roughness caused by corrosion.

The clamp creates a rigid attachment.

The clamp supports the anode body at a spaced position from connection point.

The mounting arrangement promotes more uniform current distribution since the anode is held at a position not very close to one bar and therefore passes most current more uniformly because of reduced differences in resistance.

The clamp does not easily rotate around steel bar like a wire wrap connection.

The clamped connection does not loosen as a result of any rotation of the anode body relative to the bar.

Anode body does not rotate or fall to the down position due to gravity

The mechanical clamp allows the installer to position the anode on a selected bar within the section of concrete/mortar to be cast.

The connector allows anodes to be manufactured with a standard threaded rod as the first abutment.

In an arrangement using a power supply, the connection acts to firmly connect one pole of the supply to the reinforcing steel and ensure the other pole is spaced and will not contact the steel as this would cause a short circuit, drain the power supply such as a battery and provide no corrosion protection to the steel.

Different connectors can be provided for different size ranges.

Teeth or knife/sharp edges can be provided on an inside opening of a cavity defined by the hook member to bite into the reinforcing bar.

A concave end and additional teeth on the end of the threaded rod can act to cut into reinforcing bar.

These features ensure secure rigid, physical and electrical connection.

In this arrangement, the components act as a limiter but not a regulator. The current is not sustained at a higher value than the natural value which will occur due to the applied voltage and the resistivity of the system.

In this way the electrical components act to extend the life of a battery, or other power supply system, or galvanic anode system as these have limited capacity and do not function after the limited capacity is consumed or the system will function at a reduced capacity over time if it is allowed to initially function at its natural, unrestricted level. At the same time the system can be designed to provide a higher natural (unrestricted) level of current at the outset than is required which is then limited by the reverse diode or other device which performs a similar function to provide the required current so the required current remains in effect for an extended time.

Preferably the electrical components form part of a combined unit which includes the anode and a connector for connection to the reinforcing bar, for example an arrangement of the type as described above.

Preferably the current limiter described above is associated with and operates only in respect of a single anode and is not part of a larger system limiting or regulating current to a plurality of anodes.

In one particularly preferred method, the anode is installed and connected to the metal section while the ionically conductive material is unset and the limitation of the current by the electrical components prevents gas generation during curing of the ionically conductive material. The generation of gases during setting is a severe problem in that it forms bubbles in the concrete.

The arrangement described herein can be used in a system where the voltage difference is generated by a storage component of electrical energy with two poles for communicating electrical current generated by release of the electrical energy and by electrically connecting one pole to the metal section and by electrically connecting the other pole to the anode. However the same current limiting system and the same mechanical connection can be used with sacrificial or galvanic anodes and also with combined systems where there is both an impressed current anode driven by a power supply and a separate sacrificial anode.

In this arrangement, preferably the anode and the storage component are both at least partly contained in or buried in the ionically conductive material, typically concrete.

In this arrangement preferably the storage component is connected as a single unit with an impressed current or non-sacrificial anode and/or with a sacrificial anode.

In this arrangement preferably the storage component is contained within a closed or sealed canister defining the anode on an exterior surface. In this case the anode can be formed of stainless steel.

In this arrangement in some cases in order to provide a longer life replacement electrical energy can be introduced by re-charging the storage component or by replacing the storage component.

The storage component can be a cell or battery of cells or can be a capacitor.

The arrangement therefore described above provides an arrangement which acts to limit the current between the anode and the reinforcing bar. This arrangement can provide one or more of the following features:

It acts to regulate current from a battery, capacitor or galvanic anode.

The circuit may reduce the available voltage when the current is being limited but does not reduce the total current available to protect the steel. This is ideal for battery or galvanic anode systems as these have limited capacity (limited stored charge) and do not function after the limited capacity is consumed.

The current can be limited over a wide range of circuit resistances from short circuit to resistance where the available voltage is sufficient to result in the full set, desired current value.

The current limiter can be part of a combined unit which includes battery or capacitor or anode and connector.

The current limiter allows batteries or high output anodes to be installed and connected to the steel in fresh concrete/mortar without detrimental effects of high current densities discharging through the low resistance fresh material which can cause gas generation (oxygen and hydrogen) during curing which will create gas bubbles, voids, reduce bond to the steel and leave pores/capillaries in the concrete/mortar. Pores/cavities allow direct path to steel for water and salts to penetrate and CO2 to carbonate the concrete. All of which lead to premature corrosion of the steel.

The current limiter also extends the service life of high voltage anodes such as batteries and high surface area (high initial current output) sacrificial or impressed current anodes. Using the current limiter saves capacity of the battery and/or anode such that improved performance and higher current output from the anode(s) may be achieved in the future. The desired current output as allowed by the current limiter can be provided for a much longer period of time.

Where, as stated above the anode is not sacrificial to the metal section, typically the material is therefore electropositive relative to the metal section. However, some part of the anode may be sacrificial or the anode may be fully sacrificial.

The arrangement herein can be used where the anode is in the form of a plurality of associated anodes all connected to the cell or battery of cells.

The storage component as defined above can be a cell or battery or battery of cells/batteries or it can be a capacitor or a supercapacitor or ultracapacitor which provides a system for storing charge different from conventional electrolytic cells or batteries. A supercapacitor is a high-capacity electrochemical capacitor with capacitance values much higher than other capacitors. These capacitors typically have lower voltage limits than standard or conventional capacitors. They typically store 10 to 100 times more energy per unit volume or mass than standard capacitors, can accept and deliver charge much faster than batteries, and tolerate many more charge and discharge cycles than rechargeable batteries. Supercapacitors do not use the conventional solid dielectric of standard capacitors. They use electrostatic double-layer capacitance or electrochemical pseudo-capacitance or a combination of both instead. Electrostatic double-layer capacitors use carbon electrodes or derivatives with much higher electrostatic double-layer capacitance than electrochemical pseudo-capacitance, achieving separation of charge in a Helmholtz double layer at the interface between the surface of a conductive electrode and an electrolyte. The separation of charge is of the order of a few angstroms (0.3-0.8 nm), much smaller than in a conventional capacitor.

Supercapacitors are a great advancement on normal capacitors being capable of storing a high charge once fully charged. The capacity of a 2.7V 200 F supercapacitor is capable of holding a charge of the order of over 500 C (A×seconds). Typical cathodic protection systems require around 170 to 400 C/m2 of steel per day so such a capacitor is able to provide, when fully charged, enough charge to protect 1 m2 or more of steel for a day. This represents 2-5 mA/m2 current density. In order for example to double this figure then we need to double the capacitance to around 400 F. If the capacitor is recharged on a daily basis, then logistically, a system utilising supercapacitors of this size spaced at intervals to provide current for 1 m2 or more of steel can be an effective cathodic protection system. Daily recharging can easily be provided by solar panels, for example, but other means of producing reasonably regular bursts of current could be used as charging components for the supercapacitors. An example of such could be piezoelectric materials which can be incorporated in roads, parking garages, bridges, runways etc. enabling current to be generated by loading and/or movement of the structure or vehicles passing over them.

That is, piezoelectric materials could be used to generate electricity to power an impressed current system directly, or to charge/recharge batteries or capacitors/supercapacitors.

In some embodiments the anode is a sacrificial anode formed of a material which is less noble than the metal section to be protected. However in other cases the anode is not less noble than the metal sections to be protected so that it is the same as the metal, typically steel or is more noble than the steel; so that it is partially or fully inert during the process. If the anode is formed of a sufficiently inert material, the anode does not corrode significantly during the flow of the electrons.

High current output is required from the storage component such as a battery. As described above, one pole is connected to the metal section to be protected. Electrons flow from the storage component to the metal section such that corrosion of the metal section is reduced. The other pole is connected to an anode or if suitable, the casing of the storage component itself can be used as the anode. In the case of a zinc-alkaline battery the polarity of the battery is such that the case of the battery, if it is made of a suitable material will act as the anode and will be able to distribute the necessary current through the ionically conductive material such as mortar or concrete. Other batteries, such as most lithium batteries, typically have only a small pole which has the proper polarity which may not be large enough to deliver the required current into the ionically conductive material. A separate anode can be provided for connection to the appropriate pole. The anode may encase or coat the whole storage component such as a battery or capacitor. Anodes can be made of any inert conductive material such as MMO coated titanium or other noble metal or sub-metal, conductive coating, conductive ceramic material etc. and can be embedded in an alkaline mortar or an inert material such as sand which may be dosed with an alkali solution. Stainless steel can also be a suitable current carrier when embedded in mortar or compacted sand dosed with alkali such as a saturated solution of lithium hydroxide. Anodes may also comprise sacrificial materials such as zinc which are less noble than the metal section to be protected.

Typically the single unit comprising the storage component and the anode or anodes is at least partly buried in the ionically conductive material. However application to the surface or other modes of mounting where the anode is in ionic contact with the material can be used.

In one particularly preferred arrangement the storage component comprises a cell with an outer case wherein the case is fully or partially formed of the anode material so that the anode is formed by the outer case either by an outer surface of the same material or as a coating or layer on the exterior of the case. In this case the outer case or at least the outer layer can be formed of a material which is more noble than steel. In this arrangement the anode forms directly the outer case of the cell where the case contains and houses the cathode material of the cell, the electrolyte, the anode material and other components of the cell. That is, in this embodiment, the anode is defined by a layer or coating on the outer surface of the storage component itself or actually as the outer surface of the storage component and not as an additional element which is separate from the storage component. Where the storage component is a cell, the outer case of the cell can directly carry the material of the anode or even the outer case of the cell is the anode. The anode material may cover the whole surface or may be a partial covering leaving other areas exposed.

In another arrangement the case and the anode are formed independently and the anode forms a separate body which conforms in shape to the outer case of the cell. Typically such cells are cylindrical but other shapes can be used. This arrangement is particularly applicable where the cell is replaceable rather than rechargeable to introduce the additional energy after the original cell is sufficiently depleted to be no longer effective.

In another arrangement the anode is a separate body which is electrically connected to one terminal of the storage component.

The above features can be preferably used for protection of steel reinforcing or structural members in concrete or mortar material where it is well known that corrosion can cause breakdown of the concrete due to the expansive forces of the corrosion products and due to the reduction to the steel strength. However uses in other situations can arise.

The term impressed current anode used herein is intended to distinguish from the sacrificial anode where the sacrificial anode is formed of a material, typically zinc, which is less noble than the metal section so that it preferentially corrodes relative to the metal section to be protected. The impressed current anode is one which is used in conjunction with a power supply and does not need to be less noble than the metal section. Typically such impressed current anodes are formed of titanium, platinum, niobium, carbon and other noble metals and oxides which do not corrode readily, or they can be formed of iron or less noble materials such as zinc.

For use during a sacrificial or galvanic phase of operation of the above method, the ionically conductive filler material preferably contains at least one activator to ensure continued corrosion of the sacrificial anode. However the activator can also be located at other positions in the system. Suitable filler materials can be in the form of solids, gels or liquids.

Gels can include carbomethyl cellulose, starches and their derivatives, fumed silica or polymer gel electrolytes, e.g. acrylic acid in a potassium hydroxide solution or polyvinyl chloride/acetate-KOH composites with additions of bentonite, propylene carbonate and or alumina. The alkali hydroxide in these gels acts as a suitable activator.

Suitable activators include alkali hydroxides, humectants, catalytic materials and other materials which are corrosive to the sacrificial anode metal. Activators may be used alone or in combination.

For use during a sacrificial or galvanic phase of operation of the above method, the ionically conductive filler material preferably has a pH sufficiently high for corrosion of the sacrificial anode to occur and for passive film formation on the sacrificial anode to be avoided. Alternatively, the filler may have a lower pH and/or contain other activators for corrosion of the sacrificial anode to occur and for passive film formation on the sacrificial anode to be avoided.

The anode and methods herein are preferably designed for use where the metal section is steel and the ionically conductive material is concrete or mortar.

The anode apparatus including the impressed current and sacrificial components is typically buried in the concrete or other solid material so that it is fully encased by the concrete or a filler material, but this is not essential and the anode may be only partially buried or in direct or indirect physical or ionic contact with the concrete.

The anode apparatus including the impressed current and sacrificial components may be surrounded by an encapsulating material or ionically conducting filler material which may be a porous material or porous mortar material. Suitable encapsulating materials can be inorganic or organic and may be any ionically conductive cementitious, polymer or non-cementitious material or mortar including geopolymers or modified Portland cements. The encapsulating material may be solid, gel or liquid and may be deformable.

The power supply may include a solar panel which drives the impressed current anode and rechargeable galvanic anode so as to provide long term protection when the solar power is on and off.

The construction and methods proposed herein are designed particularly where the metal section is steel and the ionically conductive material is concrete or mortar. However the same arrangements may be used in other corrosion protection systems such as for pipes or other constructions in soil, and in many other systems where such anodes can be used.

Preferably the assembly includes a reinforcing layer, such as disclosed in U.S. Pat. No. 7,226,532 issued Jun. 5, 2007 to Whitmore, the disclosure of which is incorporated by reference or to which reference may be made for further details not disclosed herein, to restrain and resist forces such as expansion, contraction and deformation forces which may be caused by corrosion of the anodes, deposition of sacrificial anode ions and other physical/environmental forces such as freezing, thawing, wetting, drying and thermal expansion/contraction.

The invention as defined and described herein can also be provided as an assembly, as opposed to a method for cathodically protecting and/or passivating a metal section in an ionically conductive material. Thus the following definitions of the invention presented herein are included herein. Each of these independent definitions can be used in conjunction with any one of or all of the subsidiary features as defined above.

BRIEF DESCRIPTION OF THE DRAWINGS

Embodiments of the invention will now be described in conjunction with the accompanying drawings in which.

In the drawings like characters of reference indicate corresponding parts in the different figures.

DETAILED DESCRIPTION

Figure 4:
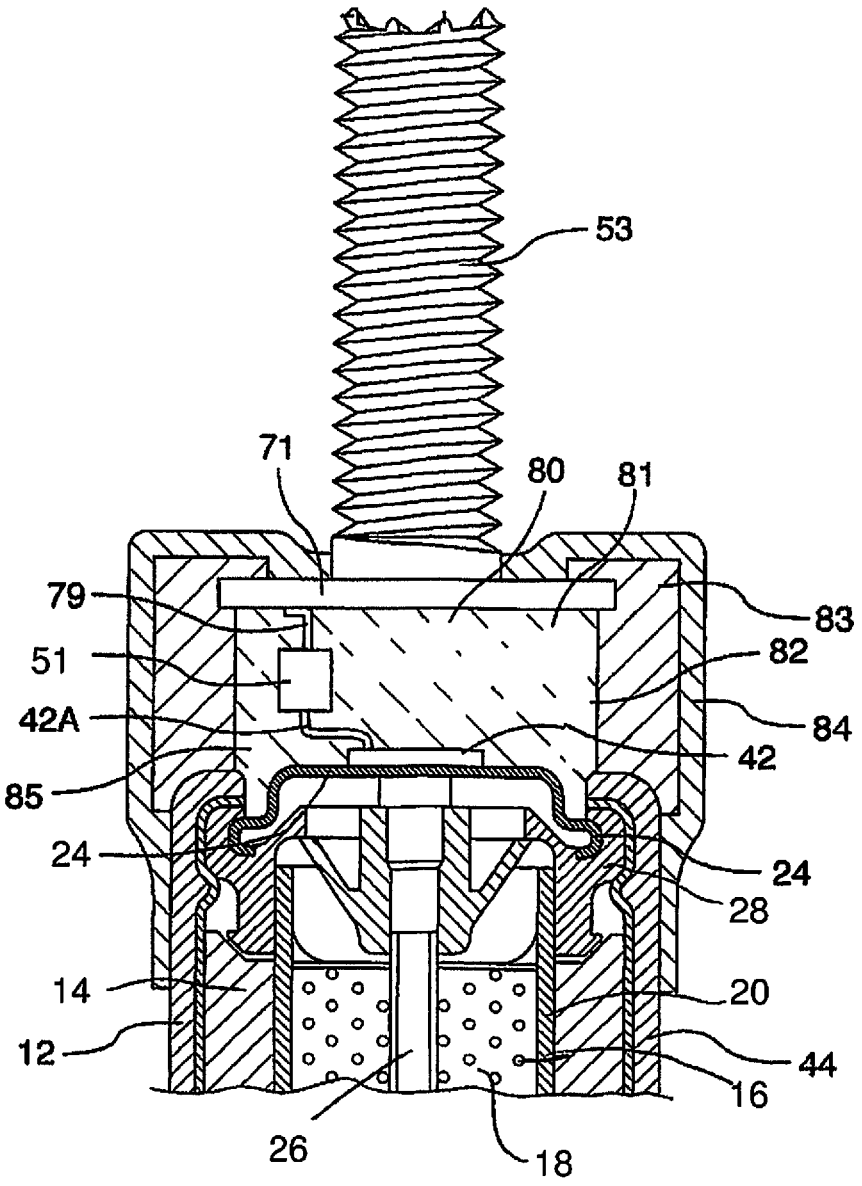
FIG. 4 is an enlarged cross-sectional view of an anode assembly of the type using a cell to provide current though an impressed current anode and using the current limiting device and mounting arrangement of FIGS. 1 and 2.
Figure 5:
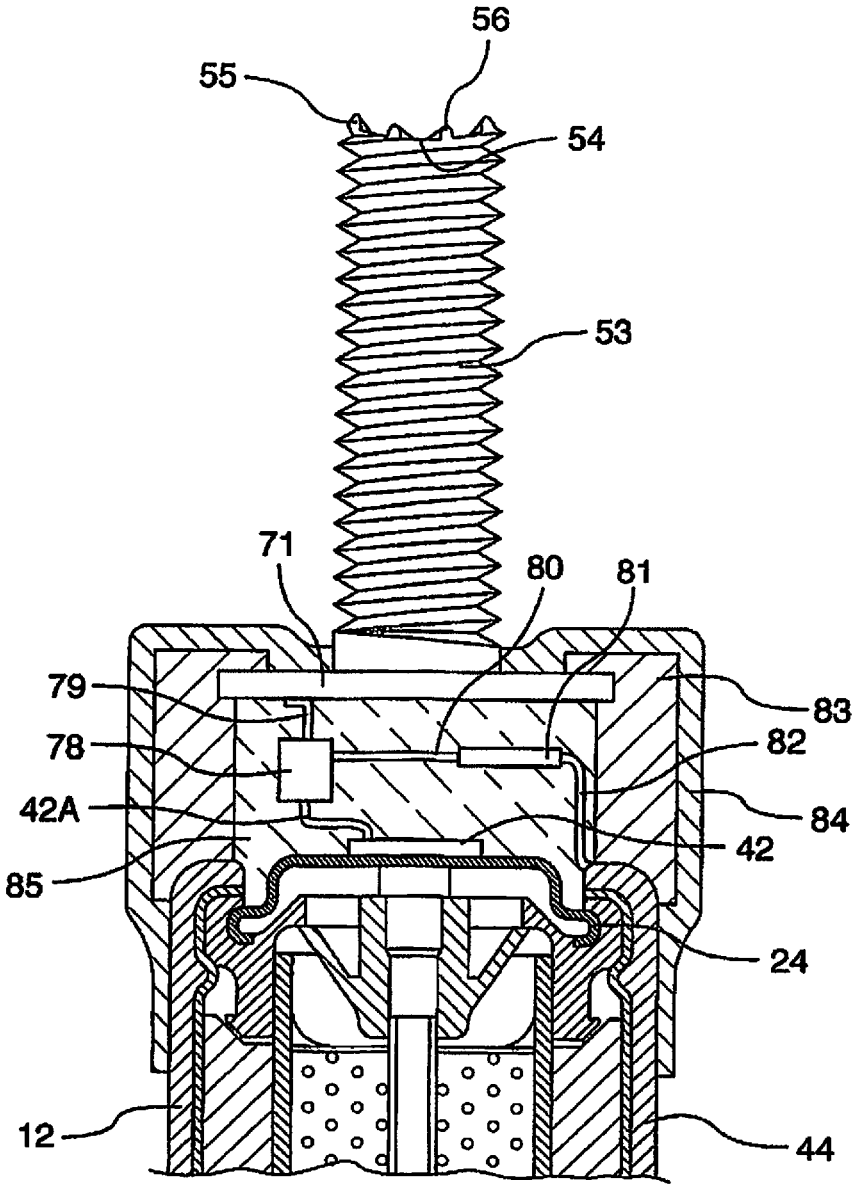
FIG. 5 is an enlarged cross-sectional view of an anode assembly of the type using a cell to provide current though an impressed current anode and a bipolar type transistor to limit the current from the cell to the steel.

In the example shown in FIGS. 4 and 5 there is provided a cell which may be rechargeable, as shown in prior PCT Application WO 2017/075699 filed Nov. 2, 2016 and published 11 May 2017, the disclosure of which may be referenced or is incorporated herein by reference, or may be a simple non-rechargeable cell. The cell may form part of the anode structure or the anode and the cell may be physically separated. The anode body 10 is defined by a typical alkaline manganese dioxide-zinc rechargeable cell comprising the following main units: a steel can 12 defining a cylindrical inner space, a manganese dioxide cathode 14 formed by a plurality of hollow cylindrical pellets 16 pressed in the can, a zinc anode 18 made of an anode gel and arranged in the hollow interior of the cathode 14, and a cylindrical separator 20 separating the anode 18 from the cathode 14. The ionic conductivity (electrolyte) between the anode and the cathode is provided by the presence of potassium hydroxide, KOH, electrolyte added into the cell in a predetermined quantity. Other types of rechargeable cells comprise similar main components (can, cathode, anode, separator and electrolyte) but the composition of the components may differ. Some of the types of cell may however be of a different construction such as lead/acid cells or lithium cells.

The can 12 is closed at the bottom, and it has a central circular pip serving as the positive terminal. The upper end of the can 12 is hermetically sealed by a cell closure assembly which comprises a negative cap 24 formed by a thin metal sheet, a current collector nail 26 attached to the negative cap 24 and penetrating deeply into the anode gel to provide electrical contact with the anode, and a plastic top 28 electrically insulating the negative cap 24 from the can 12 and separating gas spaces formed beyond the cathode and anode structures, respectively.

Other types of rechargeable cells may be used. In the present arrangement, the type described above is used in a method for cathodically protecting and/or passivating a metal section such as steel reinforcing bar 40 in an ionically conductive material such as concrete 41. The cell therefore includes a first terminal 42 and a second terminal 43 defined by the outer casing 12. The first terminal 42 is connected to the pin or nail 26 which is engaged into the anode material 18. The terminal 42 connects to a connecting wire 42A which extends from the terminal 42 to threaded connector 53 for eventual connection to the steel reinforcing bar 40 as shown in FIG. 4 through the mounting assembly generally indicated at 50 which mechanically and electrically attaches the anode body to the bar 40.

In FIG. 4, an anode 44 is applied as a coating onto the casing 12 of the cell. In this embodiment the anode 44 is of an inert material so that it is more noble than steel. Examples of such materials are well known. Thus the anode material 44 does not corrode or significantly corrode during the cathodic protection process.

In this arrangement the application of the anode 44 onto the outside surface of the casing 12 provides the structure as a common single unit where the anode is directly connected to the cell and forms an integral element with the cell. Anode 44 may comprise one or more layers and may include a mixed metal oxide (MMO), catalytic or sub-oxide layer.

In this embodiment, as the anode 44 is formed of an inert material which does not corrode in the protection process, the anode and the cell contained therein can be directly incorporated or buried in the concrete or other ionically conductive material without the necessity for an intervening encapsulating material such as a porous mortar matrix. As there are no corrosion products there is no requirement to absorb such products or the expansive forces generated thereby. As the process does not depend upon continued corrosion of a sacrificial anode, there is no necessity for activators at the surface of the anode. As the chemical reaction at the surface of any inert anode during operation generates acid (or consumes alkali) it is beneficial for the anode to be buried in an alkaline material such as concrete or high alkalinity mortar to prevent material near the anode from becoming acidic. If desired, additional alkali may be added to the concrete or other material the anode is in contact with.

The apparatus shown herein includes an anode body generally indicated at 10 which is connected to the reinforcing bar 40 by the mounting assembly generally indicated at 50. In addition, the anode body includes a current limiting system generally indicated at 51 which limits the flow of current from the anode body to the bar 40.

As previously described, the anode body can be defined by a power supply typically in the form of a cell with the anode 44 on the outside surface of the cell and with the other terminal of the cell provided at the end of the cell for connection to the bar 40.

In other embodiments shown in FIGS. 1, 2, 3 and 6 to 8, the cell can be omitted in which case the anode body comprises a sacrificial material which is less noble than the steel rebar, such as zinc where a voltage between the anode and the bar comprises the galvanic voltage between the two metal components.

In yet another embodiment, the anode body can comprise a combination of both an impressed current anode and a sacrificial anode.

In this way the anode body is constructed and arranged so that when the anode is ionically connected to the concrete, a voltage difference is generated between the anode 44 and/or 74 and the bar 40 so as to cause a current to flow through the concrete between the anode and the bar 40 so to provide cathodic protection and/or passivation of the reinforcing bar in the concrete.

In the embodiment shown in FIGS. 1, 2, 4 and 5, the mounting assembly is of the type shown in Published PCT application WO 2019/006540 filed 15 May 2018 and published 10 Jan. 2019, the disclosure of which may be referenced or is incorporated herein by reference.

The mounting 50 comprises a first abutment in the form of a threaded rod 53 which is attached at one end to the anode body 10 and a second abutment 57 for engaging generally the opposed the face of the bar 40. In general the second abutment forms a hook member with two legs 68 and 69 which contact the opposite or rear surface of the bar 40 to provide a stable engagement.

In this embodiment the female threaded portion is provided by a threaded hole through the flange 67. A screw action pulling the second abutment member toward the anode body is therefore provided by rotating the rod 53. This can most effectively be done by grasping manually the anode body and using it as a handle to turn the rod 53.

Of course, this requires a strong connection between the bottom end of the rod 53 and the anode body. This connection is provided by a base plate 71 attached onto the bottom end of the rod 53 and engaged firmly into the upper end of the anode body. The solid anode body 74 includes a conventional covering of a mortar material 75 for purposes of retaining corrosion products and of carrying conventional activating materials described herein before.

Turning now to FIG. 4, there is shown in more detail the connection between the terminal 42 of the cell and the rod 53 which is electrically connected to the bar 40 as described above.

The terminal 42 is connected to a wire 42A which in turn is connected to a diode 51. An output wire 79 of the diode 51 is connected to the base plate 71 connected to the rod 53.

The diode 51 can be a conventional diode connected in reverse polarity so as to prevent flow of current between the anode and the bar 40. In this arrangement, the reverse or leakage current acts to limit the flow of current from the anode to the bar 40 to a value of the order of 0.1 to 1 milliamp. This maximum value is retained regardless of the conductivity between the anode 44 and the bar 40 through the concrete. If the conductivity through the concrete is very high, for example during an initial installation when the concrete is fresh, the current is maintained at the maximum value. As the conductivity through the concrete falls to a lower level (resistivity increases), the current is maintained at the desired level until the voltage drop through the concrete and the circuit (V=IR) at $I_{Max}$ reaches the voltage of the cell. If the conductivity falls to a yet lower level, the current through the diode or transistor also falls dependent upon the conductivity and is not maintained by the action of the diode or transistor 51. The simple circuit therefore provided by the diode 51 does not act as a regulator but instead merely acts as a current limiter.

Figure 1:
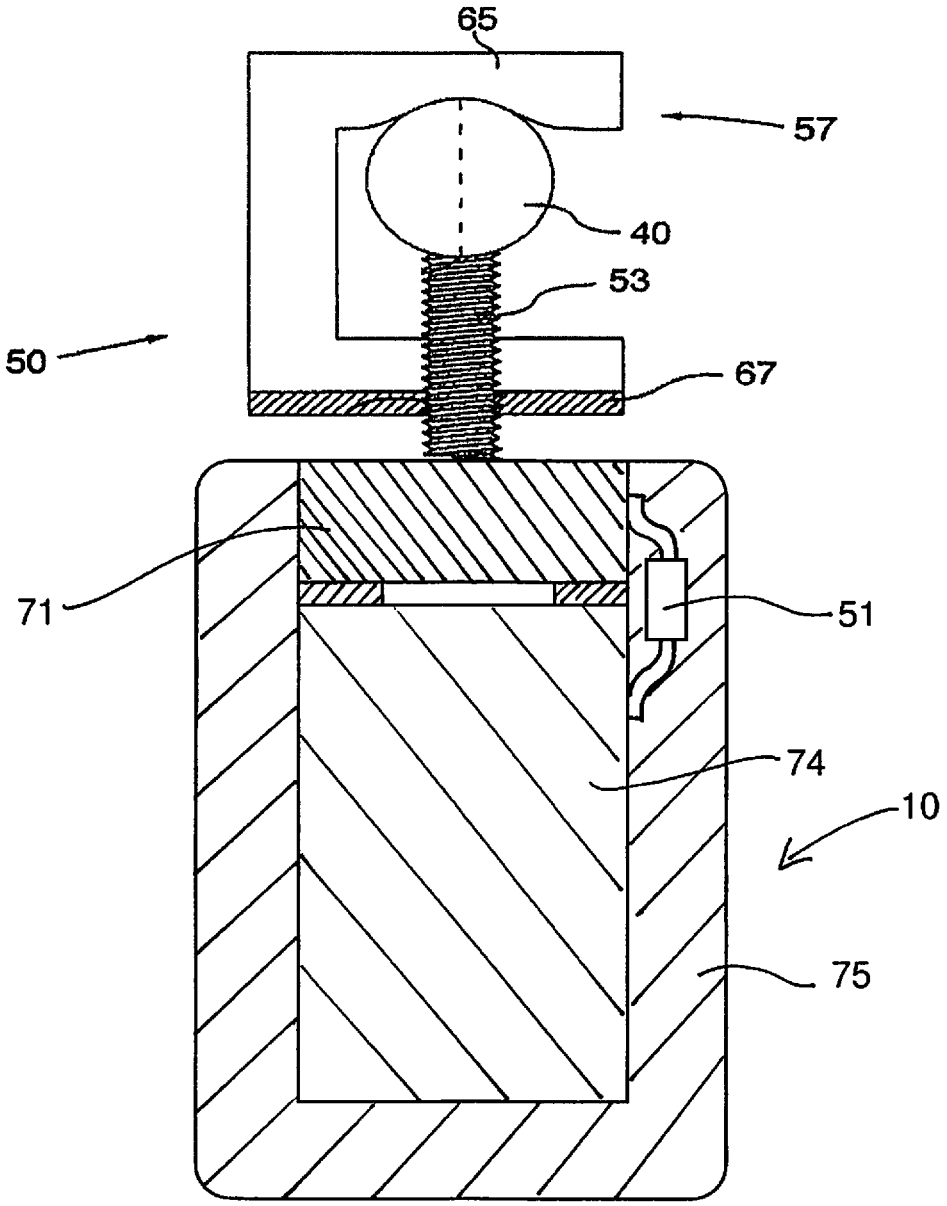
FIG. 1 is a cross-sectional view of an anode assembly using a sacrificial anode for use in a corrosion protection method according to the present invention.
Figure 2:
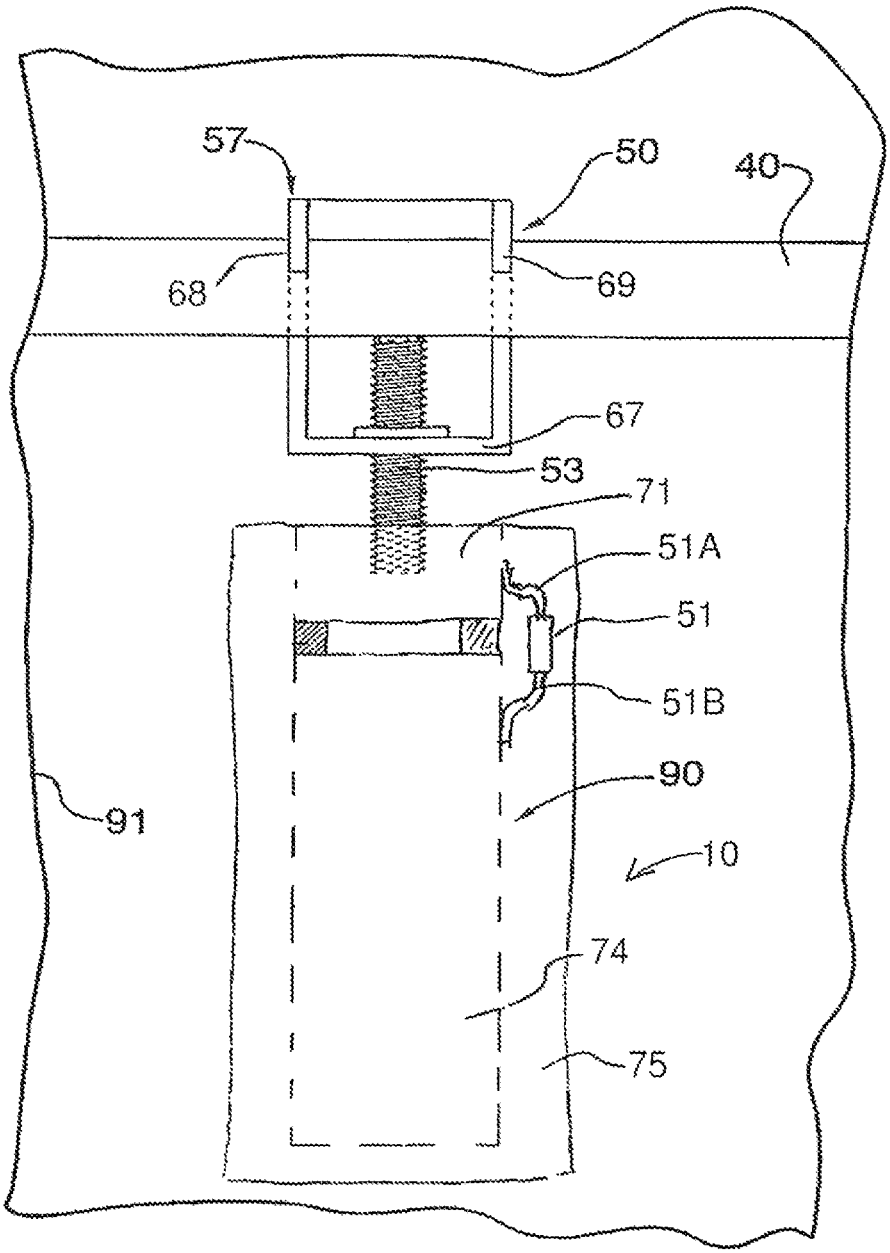
FIG. 2 is a side elevational view of the anode assembly of FIG. 1.

FIGS. 1 and 2 show applications of the current limiting device in use with a galvanic anode. In this arrangement, the diode or transistor 51 is connected by wires 51A and 51B connected between the anode 74 and the support plate 71 which is connected to the rod 53.

Limitation of the current to a maximum value set during manufacture by the selection of the diode 51 can ensure that the current remains during the life of the system at a relatively low level so as to dramatically increase the lifetime of the cell from a typical value in the absence of the current limiter which could be of the order of one year up to a more suitable lifetime of 10 years for example. The life of a galvanic anode may be extended from 5 to 10 years to over 50 years for example. In this way the current is maintained at a value which is suitable for cathodic protection but at no time is there any excess current over and beyond this desirable value which may damage the concrete or deplete the cell prematurely or degrade and shorten the life of a galvanic anode such that corrosion protection is not provided for the desired timeframe.

This arrangement is valuable in relation to an arrangement which uses a non-sacrificial impressed current anode and a cell as the power supply for generating the required voltage. In such an arrangement the current generated between the anode 44 and the bar 40 can in some circumstances significantly exceed the desirable value.

In order to connect the terminal 42 to the rod 53, there is provided an insulating or protective collar 83 surrounding the diode 51. The bottom end of the collar is attached to the top end of the cell and the top end of the collar receives the base plate 71 in a suitable receptacle portion. The collar 83 is attached to the cell 44 by a surrounding insulating layer 84 of a suitable plastic material. Inside the collar 83 is provided a conventional potting material 85 which surrounds the diode 51 and wires to maintain connection and to prevent damage from moisture penetration. The structure is thus sufficiently strong to ensure that the base plate 71 is attached to the cell in a manner which allows the cell to be grasped manually and rotated as an operating handle to rotate the rod 53.

In the present method for cathodically protecting and/or passivating a metal section in an ionically conductive material, as shown in FIGS. 1 and 2, a sacrificial anode 74 is provided for communication of an ionic current to the metal section 40 in the ionically conductive material 91. The anode acts for generating a voltage difference between the anode 74 and the metal section 40 so as to cause a current to flow through the ionically conductive material 91 between the anode and the metal section so as to provide cathodic protection of the metal section in the conventional manner.

The current flowing between the anode the metal section is limited to a low selected value by connecting the semi-conductor diode device 51 in an electrically conductive path between the anode and the metal. The semi-conductive device 51 maybe of the type which is arranged to pass current in a first direction and to restrict current in a second direction to a leakage current and is connected so that current between the anode and the metal passes in the second direction and thus limits the current to a maximum value defined by the leakage current.

The semi-conductor device diode 51 forms part of a combined unit including the anode and the mounting arrangement or electrical connector to be inserted in or attached to the ionically conductive concrete or mortar material.

Where there is provided a coating 75 on the anode of a porous absorption material the diode 51 can be located in the coating or in a potting material to provide suitable protection.

The wire or electrical connection 51A must be electrically connected to the anode. The wire or electrical connection preferably will be cast into the anode as indicated at 51C or connected to a connector which is cast into the anode. Less durable connections such as mechanical connections or soldering directly to the exterior of the anode can be made. Wire or connector 51B must be electrically connected to the bar 40. This wire or connector can be soldered or otherwise connected to the support plate 71 which is connected to the attachment mechanism. As the diode is typically supplied with wires which are unsuitable for direct connection to the bar 40, typically the diode needs to be attached to the mounting 71 which provides structural support for the attachment mechanism.

Figure 3:
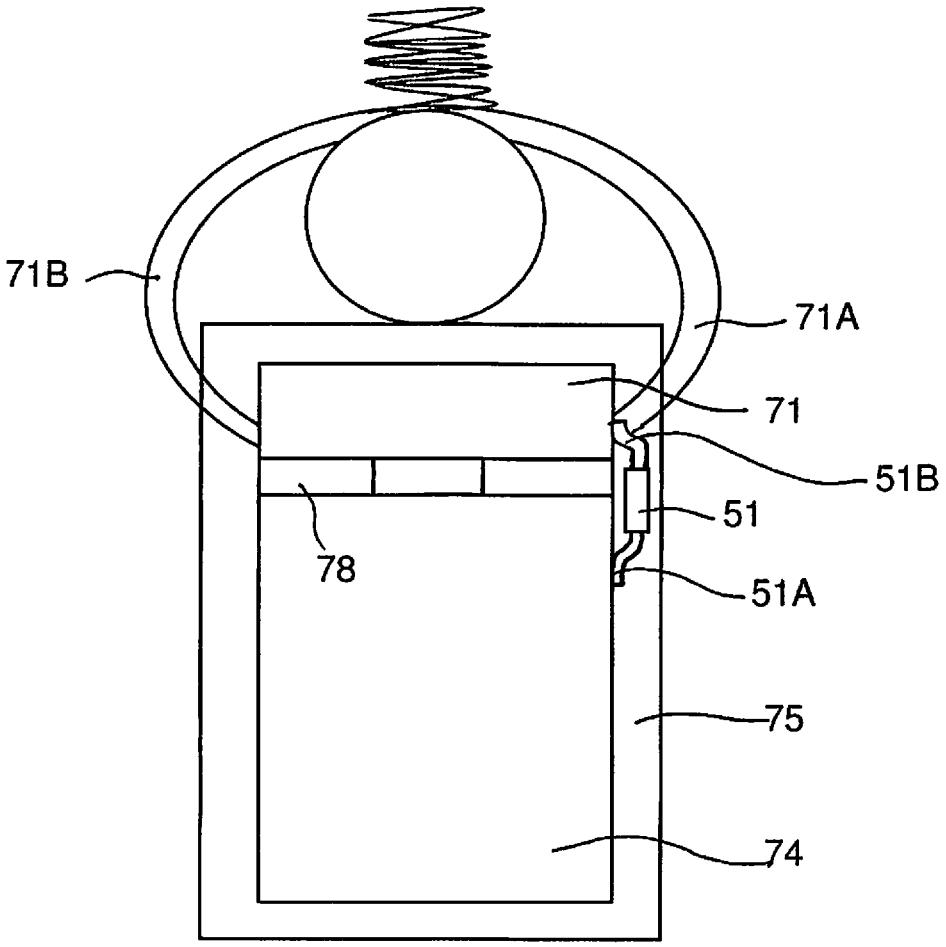
FIG. 3 is a cross-sectional view of an anode assembly similar to that of FIG. 1 but using a conventional wire wrapping attachment method to the metal section.

Many types of attachment can be used including the hook and rod system described above and the traditional flexible wire arrangement which is used to wrap around the bar 40 as shown in FIG. 3 where two wires 71A and 71B are connected to the mounting 71 or directly connected to at least one wire or other electrical connector to connect to the bar 40. The sacrificial anode 74 is attached structurally to the mounting plate 71 by an insulating member 78 to form a common unit which can be easily handled and inserted into the material.

In the embodiments shown therefore the anode 74 includes an electrically conductive connector for electrically connecting the anode to the metal section 40 and the diode 51 is located in the electrical connection between the anode and the connector.

Turning now to the arrangements shown in FIGS. 5 to 9 there is method for cathodically protecting and/or passivating a steel member 101 buried in or in contact with an ionically conductive concrete or mortar material 99. Using the constructions shown in FIGS. 1 to 4, there is provided an anode construction 100 for communication of an electrical current to the steel member 101 in the ionically conductive material 99.

Figure 6:
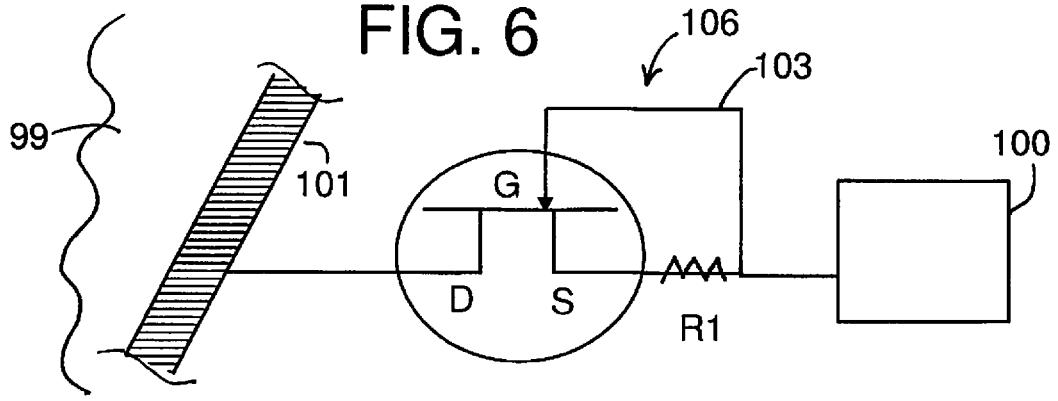
FIGS. 6 to 9 show schematic illustrations of four embodiments of current limiting system which uses a gate controlled FET to limit the current in the electrically conductive circuit connecting an anode to the steel member.
Figure 7:
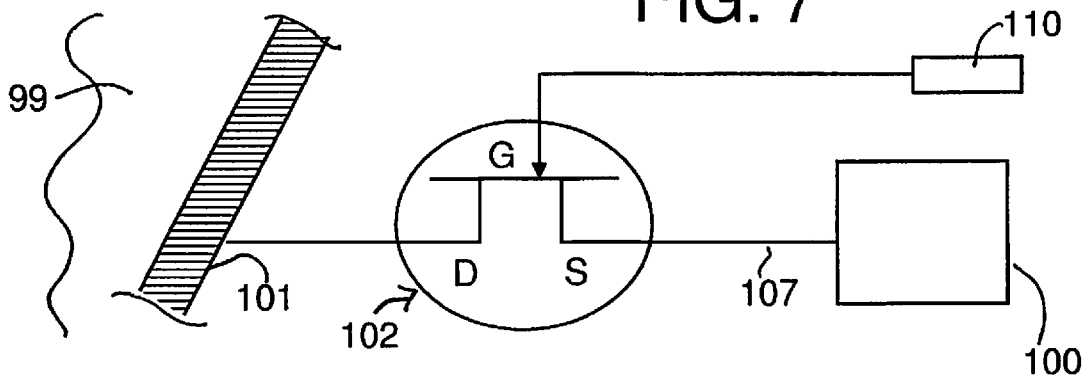
Figure 8:
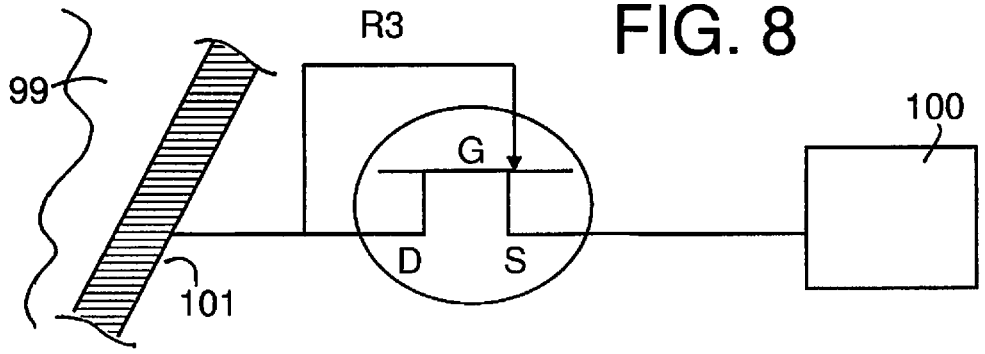
Figure 9:
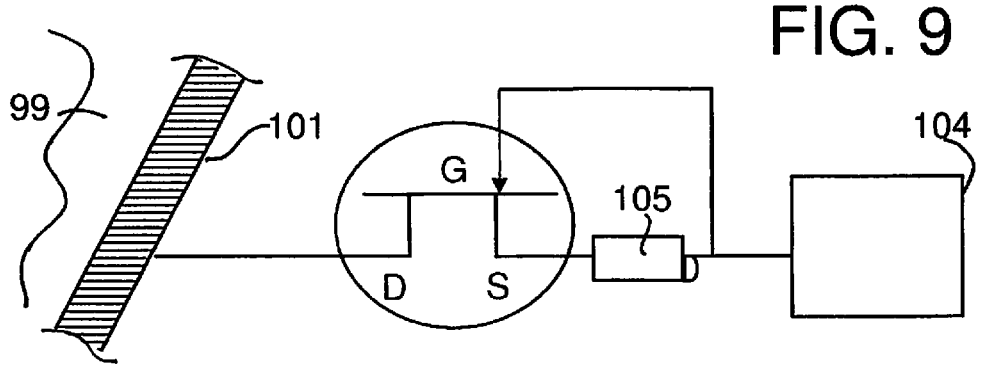

By using the sacrificial anodes of FIGS. 6 to 8 or the impressed current anode of FIG. 9, a voltage difference is generated between the anode construction 100 or 104 and the steel member 101 so as to cause a current to flow through the ionically conductive material 99 between the anode 100, 104 and the steel member so as to provide cathodic protection of the steel member. The anode 104 of FIG. 9 is powered by a power supply 105 such as a simple cell connected between the anode and the steel 101.

In accordance with the invention described herein there are provided electrical components 106 which limit the current to a maximum value with the electrical components 106 including at least one electrical conductor 107 connected to the anode construction. As shown schematically in these figures and in more detail in FIGS. 1 to 4, the electrical components including the electrical conductor and the anode construction form components of a common body which is attached to or buried in the concrete or mortar material as a single unit.

Turning now to FIG. 5, there is shown in more detail the connection between the terminal 42 of the cell and the rod 53 which is electrically connected to the bar 40 as described above.

The terminal 42 is connected to a wire 42A which in turn is connected to a transistor 78. An output wire 79 of the transistor 78 is connected to the base plate 71 connected to the rod 53.

The transistor 78 in this embodiment is a conventional or bipolar transistor in which case a base of the transistor 78 has a control current provided by a wire 80 connected through a resistor 81 in turn connected through a wire 82 to the positive terminal of the battery connected to the anode 44.

As the transistor 78 is connected to the steel bar 40 and the wire 82 is connected to the anode 44, the control current to the transistor 78 is determined by the voltage across the cell and the resistance of resistor 81. As this voltage is typically relatively constant at least until the cell is in its later stages of life, this constant control current controls the amount of current flowing through the transistor from the cell to the bar 40. As is well known the resistor 81 can be selected to provide a control base current to the transistor which sets the current flow through the transistor to a maximum value. This maximum value is retained regardless of the conductivity between the anode 44 and the bar 40 through the concrete. As the conductivity through the concrete is very high, for example during an initial installation, the current is maintained at the maximum value. As the conductivity through the concrete falls to a lower level, the current is maintained at the desired level until the maximum voltage of the cell is reached. If the conductivity falls to a yet lower level, the current through the transistor also falls dependent upon the conductivity and is not maintained by the action of the transistor. The simple circuit therefore provided by the resistor and the transistor does not act as a regulator but instead merely acts as a current limiter.

As shown in FIGS. 6 to 9 a current limiting circuit between the anode 100 and the steel member 101 uses a field effect transistor 102 in the electrically conductive circuit 107 which acts to limit the current between the steel member and the anode construction to a maximum value. The current through the transistor is limited by a control voltage applied to a gate of the transistor. The transistor is typically a suitable form of Field effect transistor so that the control terminal acts as a gate. An arrangement is provided in the electrically conductive circuit for generating control voltage from the voltage difference between the anode and the steel member. In FIGS. 6 to 8 this voltage difference is galvanic. In FIG. 8 it is generated in response to the power supply 105.

The anode construction and the transistor form, as shown in FIGS. 1 to 4, components of a common body which is at least partly buried as a single unit in the concrete or mortar material. The transistor uses the voltage difference between anode construction and the steel member and in some cases a resistor to generate a reference voltage or current for the transistor.

In FIG. 6, a resistor R1 is located between the source S and the anode 100. This creates a voltage drop between the gate and the source and acts to enable the voltage at the gate to control the flow of current through the transistor to limit the current to a required value. This is achieved by selection of a suitable transistor having current and control characteristics along with the value of the resistor so as to provide a substantially constant current as described above.

In FIG. 7, the voltage at the gate is set by a voltage generated by a small sacrificial anode 110 also located in the concrete. This anode is separate from the anode 100 and is not provided to directly or significantly assist in the corrosion protection but instead to provide the reference voltage at the gate. The voltage is generated galvanically relative to the steel 101 and remains consistent over time so as to set the current through the transistor at a required restricted value.

In this arrangement typically the anode 110 can be located in the conventional mortar covering around the anode 100.

In FIG. 8, the gate G control line is connected to a location between the drain and the steel. In this location the voltage drop across the transisitor provides a gate voltage which is suitable to set the current flow at a required limited level.

In each of these arrangements, the circuit operates to generate the required gate voltage to maintain the gate voltage above or below a threshold value and to thus control the current passing through the transistor between source S and drain D at the required limited value described herein.

In each of these arrangements of FIGS. 7 and 8 there is no additional resistor in the line from the anode to the steel which, if present, would act to reduce current flow when the system has reached an age and condition when the transistor is no longer acting to limit the current. At that stage the system provides the maximum available current due to the limited voltage drop between the anode and the steel.

The arrangement used n FIG. 9 uses a cell 105 to generate the voltage between an impressed current anode 104 and the steel 101. It will be noted that the cell is located in the line from the anode to the transistor and the gate voltage is set by the voltage drop across the cell.

As a further alternative, not shown, the gate voltage can be provided by a cell provided in the circuit. This arrangement has the advantage that the voltage can be more easily determined and maintained but of course increases cost and complexity.

Typically the transistor 102 is a normally closed transistor so that, if the control voltage or current falls below a threshold, the transistor defaults to a closed position and allows continued passage of current between the anode and the steel member.

The transistor is a normally closed MOSFET transistor with a gate to source voltage of less than 0.7V.

Since various modifications can be made in my invention as herein above described, and many apparently widely different embodiments of same may be made within the spirit and scope of the claims without department from such spirit and scope, it is intended that all matter contained in the accompanying specification shall be interpreted as illustrative only and not in a limiting sense.

The invention claimed is:

1. A method for cathodically protecting and/or passivating a steel member in an ionically conductive concrete or mortar material, comprising:

providing an anode construction for communication of an ionic current to the steel member in the ionically conductive material;

generating a voltage difference between the anode construction and the steel member so as to cause a current to flow through the ionically conductive material between the anode construction and the steel member so as to provide cathodic protection of the steel member;

providing at least one electrically conductive circuit between the anode construction and the steel member;

and connecting a device in said circuit wherein the device is arranged to pass current in a first direction and which has an insulative mode in a second direction of a type which allows a leakage current when operating in the insulative mode;

and applying said voltage difference across the device in the insulative mode such that the leakage current passes through the device in the insulative mode and thus limits the current to a maximum value defined by the leakage current.

2. The method according to claim 1 wherein the device is a semi-conductor.

3. The method according to claim 1 wherein the device includes a P-N junction.

4. The method according to claim 1 wherein the device is a diode.

5. The method according to claim 1 wherein the device is a capacitor.

6. The method according to claim 1 wherein the anode construction comprises a sacrificial anode.

7. The method according to claim 1 wherein the anode construction comprises an impressed current anode.

8. The method according to claim 1 wherein the anode construction is buried in the concrete or mortar material while in an unset condition and the concrete or mortar material is caused to set with the anode construction therein and wherein said device which limits the current to said maximum value acts to restrict formation of gas bubbles in the concrete or mortar material at the steel member and/or at the anode while the concrete or mortar material sets.

9. The method according to claim 1 wherein said anode construction comprises a sacrificial anode and an impressed current anode generating said voltage difference between the sacrificial anode and the steel member so as to cause a first current to flow through the ionically conductive concrete or mortar material between the first sacrificial anode and the steel member so as to provide cathodic protection of the steel member wherein said voltage difference between the impressed current anode and the steel member is generated by a storage component of electrical energy.

10. The method according to claim 9 wherein said storage component is contained within a sleeve or canister defining the anode construction on an exterior surface.

11. The method according to claim 10 wherein the anode construction comprises stainless steel.

* * * * *